US010962196B2

(12) United States Patent
Redjem Saad et al.

(10) Patent No.: US 10,962,196 B2
(45) Date of Patent: Mar. 30, 2021

(54) LIGHTING MODULE FOR A MOTOR VEHICLE

(71) Applicant: VALEO VISION, Bobigny (FR)

(72) Inventors: Lotfi Redjem Saad, Bobigny (FR); Francois Berrezai, Angers (FR); Francois Cormier, Angers (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/015,562

(22) Filed: Jun. 22, 2018

(65) Prior Publication Data

US 2018/0372298 A1 Dec. 27, 2018

(30) Foreign Application Priority Data

Jun. 23, 2017 (FR) ..... 17 55752

(51) Int. Cl.
*F21S 8/00* (2006.01)
*F21S 45/47* (2018.01)
(Continued)

(52) U.S. Cl.
CPC ..... *F21S 45/47* (2018.01); *F21S 41/143* (2018.01); *F21S 41/151* (2018.01);
(Continued)

(58) Field of Classification Search
CPC ..... F21S 45/47; F21S 41/151; F21S 41/192; F21S 41/143; F21S 45/43; F21S 45/49;
(Continued)

(56) References Cited

U.S. PATENT DOCUMENTS

2010/0259935 A1 10/2010 Scordino et al.
2010/0264826 A1* 10/2010 Yatsuda ..... F21K 9/00 315/112
(Continued)

FOREIGN PATENT DOCUMENTS

CN 101865385 A 10/2010
CN 102155699 A 8/2011
(Continued)

OTHER PUBLICATIONS

French Preliminary Search Report dated Oct. 3, 2017 in French Application 17 55752 filed on Jun. 23, 2017 (with English Translation of Categories of Cited Documents).
(Continued)

*Primary Examiner* — William J Carter
*Assistant Examiner* — Omar Rojas Cadima
(74) *Attorney, Agent, or Firm* — Oblon, McClelland, Maier & Neustadt, L.L.P.

(57) ABSTRACT

A lighting module for a motor vehicle including: a support plate; at least one source of light which is arranged on a first face of the support plate; a heat dissipater which is arranged on a second face of the support plate, opposite the first face; a fan which is arranged between the heat dissipater and a plenum, the fan being designed to aspirate a flow of hot air which is dissipated by the heat dissipater, and is obtained from an incoming flow of air; a plenum which is designed to cover the fan, the plenum including a peripheral skirt which is designed to surround the heat dissipater; an optical assembly which cooperates with rays of light of the at least one source of light, in order to produce a light beam.

19 Claims, 11 Drawing Sheets

(51) Int. Cl.

| | |
|---|---|
| ***F21S 45/43*** | (2018.01) |
| ***F21S 45/49*** | (2018.01) |
| ***F21V 29/67*** | (2015.01) |
| ***F21V 29/78*** | (2015.01) |
| ***F21V 29/80*** | (2015.01) |
| ***F21S 41/19*** | (2018.01) |
| ***F21S 41/151*** | (2018.01) |
| ***F21S 41/143*** | (2018.01) |
| *F21W 103/55* | (2018.01) |
| *F21V 29/75* | (2015.01) |
| *F21V 29/77* | (2015.01) |
| *F21W 102/145* | (2018.01) |
| *F21S 41/255* | (2018.01) |

(52) U.S. Cl.
CPC ..... *F21S 41/192* (2018.01); *F21S 45/43* (2018.01); *F21S 45/49* (2018.01); *F21V 29/677* (2015.01); *F21V 29/78* (2015.01); *F21V 29/80* (2015.01); *F21S 41/255* (2018.01); *F21V 29/75* (2015.01); *F21V 29/773* (2015.01); *F21W 2102/145* (2018.01); *F21W 2103/55* (2018.01)

(58) Field of Classification Search
CPC ..... F21S 41/255; F21S 45/42; F21S 45/33; F21S 45/48; F21S 41/141; F21S 45/10; F21V 29/80; F21V 29/78; F21V 29/677; F21V 29/75; F21V 29/773; F21V 29/83; F21V 29/67; F21V 29/74; F21V 15/01; F21V 29/767; F21V 29/89; F21W 2102/145; F21W 2103/55; F21Y 2115/10; F21Y 2103/33; F21Y 2105/10; F21K 9/00
See application file for complete search history.

(56) References Cited

U.S. PATENT DOCUMENTS

| | | | | |
|---|---|---|---|---|
| 2012/0038272 | A1 | 2/2012 | Decastro | |
| 2012/0092885 | A1* | 4/2012 | Hong | F21S 41/147 362/547 |
| 2013/0329440 | A1* | 12/2013 | Tsutsumi | F21S 41/663 362/465 |
| 2014/0293625 | A1 | 10/2014 | Sato | |
| 2014/0307441 | A1* | 10/2014 | Wu | F21V 31/005 362/267 |

FOREIGN PATENT DOCUMENTS

| | | | |
|---|---|---|---|
| DE | 10 2010 002 664 | A1 | 9/2011 |
| EP | 2 711 626 | A1 | 3/2014 |
| WO | WO 2009/071111 | A1 | 6/2009 |

OTHER PUBLICATIONS

Combined Chinese Office Action and Search Report dated May 18, 2020, in Patent Application No. 201810660780.0, 14 pages (with English translation).

* cited by examiner

LIGHTING MODULE FOR A MOTOR VEHICLE

TECHNICAL FIELD OF THE INVENTION

The present invention relates to a lighting module for a motor vehicle.

It has a particular application in lighting and/or signalling devices for a motor vehicle.

TECHNOLOGICAL BACKGROUND OF THE INVENTION

A lighting module for a motor vehicle comprises in a manner known to persons skilled in the art:

a support plate;

at least one source of light which is arranged on the said support plate;

a heat dissipater which is designed to dissipate the heat given out by the said at least one source of light;

a fan which is designed to convey a flow of ambient air to the said heat dissipater via an air duct by blowing on the said flow of ambient air;

an optical assembly which cooperates with the rays of light of the said at least one source of light, in order to produce a light beam.

A disadvantage of this prior art is that when a plurality of sources of light exists in the said lighting module, it is necessary to have very good dissipation of heat from the said sources of light. This prior art is not efficient enough to cool the said sources of light.

In this context, the present invention aims to eliminate the disadvantages previously mentioned.

GENERAL DESCRIPTION OF THE INVENTION

For this purpose, the invention proposes a lighting module for a motor vehicle, the said lighting module comprising:

a support plate;

at least one source of light which is arranged on a first face of the said support plate;

a heat dissipater which is arranged on a second face of the said support plate, opposite the said first face;

a fan which is arranged between the said heat dissipater and a plenum, the said fan being designed to aspirate a flow of hot air which is dissipated by the said heat dissipater, and is obtained from an incoming flow of air;

a plenum which is designed to cover the said fan, the said plenum comprising a peripheral skirt which is designed to surround the said heat dissipater;

an optical assembly which cooperates with rays of light of the said at least one source of light, in order to produce a light beam.

Thus, as will be seen in detail hereinafter, the plenum will make it possible to control a main incoming flow of air, such as to make the dissipation of heat by the heat dissipater more efficient, and the fan will allow the secondary flow of hot air obtained from the incoming flow of air to escape to the exterior of the plenum by aspirating the said secondary flow of hot air.

According to non-limiting embodiments, the lighting module can additionally comprise one or a plurality of supplementary characteristics from amongst the following:

According to a non-limiting embodiment, the said peripheral skirt is designed to descend as far as a distance from the base of the said heat dissipater.

According to a non-limiting embodiment, the said peripheral skirt is solid.

According to a non-limiting embodiment, the said peripheral skirt is designed to descend substantially as far as the base of the said heat dissipater.

According to a non-limiting embodiment, the said peripheral skirt comprises air inlets.

According to a non-limiting embodiment, the air inlets are lateral.

According to a non-limiting embodiment, the said plenum additionally comprises a lateral air outlet which is designed to discharge the said flow of hot air aspirated by the said fan.

According to a non-limiting embodiment, the heat dissipater comprises protuberances.

According to a non-limiting embodiment, the protuberances of the heat dissipater are pins.

According to a non-limiting embodiment, the protuberances of the heat dissipater are fins.

According to a non-limiting embodiment, the said fins comprise an end which is oriented towards a single central point of the said heat dissipater.

According to a non-limiting embodiment, the protuberances of the heat dissipater are portions of an ellipse which are parallel to one another.

According to a non-limiting embodiment, the heat dissipater additionally comprises a profiled conical form which is arranged substantially below the fan.

According to a non-limiting embodiment, a source of light is a semiconductor source of light.

According to a non-limiting embodiment, a semiconductor source of light forms part of a light-emitting diode.

According to a non-limiting embodiment, the said lighting module is designed to provide a photometric function of a segmented high beam, and a directional lighting function.

A lighting device for a motor vehicle is also proposed, comprising a lighting module according to any one of the preceding characteristics.

According to a non-limiting embodiment, the said lighting device is a front headlight for a motor vehicle.

According to a non-limiting embodiment, the front headlight is a non-dazzling high beam with an adaptive bending low beam.

According to a non-limiting embodiment, the said lighting device additionally comprises a second lighting module adjacent to the said lighting module.

According to a non-limiting embodiment, the said lighting module is designed to provide a photometric function of a segmented high beam and a directional lighting function.

According to a non-limiting embodiment, the second lighting module is designed to provide a photometric function of a high beam with a low beam.

BRIEF DESCRIPTION OF THE FIGURES

The invention and its different applications will be better understood by reading the following description and examining the figures which accompany it.

DESCRIPTION OF EMBODIMENTS OF THE INVENTION

Elements with an identical structure or function shown in different figures retain the same references, unless otherwise specified.

The lighting module 3 for a motor vehicle according to the invention is described with reference to FIGS. 1 to 23.

Motor vehicle means any type of motorised vehicle.

According to a non-limiting embodiment, the lighting module 3 is part of a lighting device (not illustrated).

According to a non-limiting embodiment, the lighting device is a front headlight for a motor vehicle. According to a non-limiting embodiment, the said front headlight is a non-dazzling high beam with a low beam with adaptive bending. The high beam generates a segmented beam known as an ADB (Advance Driving Beam) Matrix Beam, which makes it possible to make the high beam non-dazzling. The segmented beam is also known as a matrix beam. According to a non-limiting example, the beam is segmented by vertical strips. A non-dazzling high beam makes it possible to adapt the light beam produced by the lighting device automatically according to the presence of motor vehicles coming from the opposite direction or proceeding the said motor vehicle concerned.

For this application, according to a non-limiting embodiment, the lighting device comprises:

- the lighting module 3 which is designed to provide:
  - a so-called ADB Matrix Beam segmented high-beam photometric function;
  - a directional lighting function known as DBL;
- a second, adjacent lighting module (not illustrated) which is designed to provide a photometric function of a high beam with a low beam, this second lighting module thus being bifunctional. Since a bifunctional second lighting module of this type is known to persons in the art, it is not described here;
- a front outer lens (not illustrated) arranged in front of the two lighting modules.

The directional lighting function is known as DBL (Dynamic Bending Light). It makes it possible to follow the trajectory of the vehicle on bends in order to light the road better for the driver.

Figure 1:
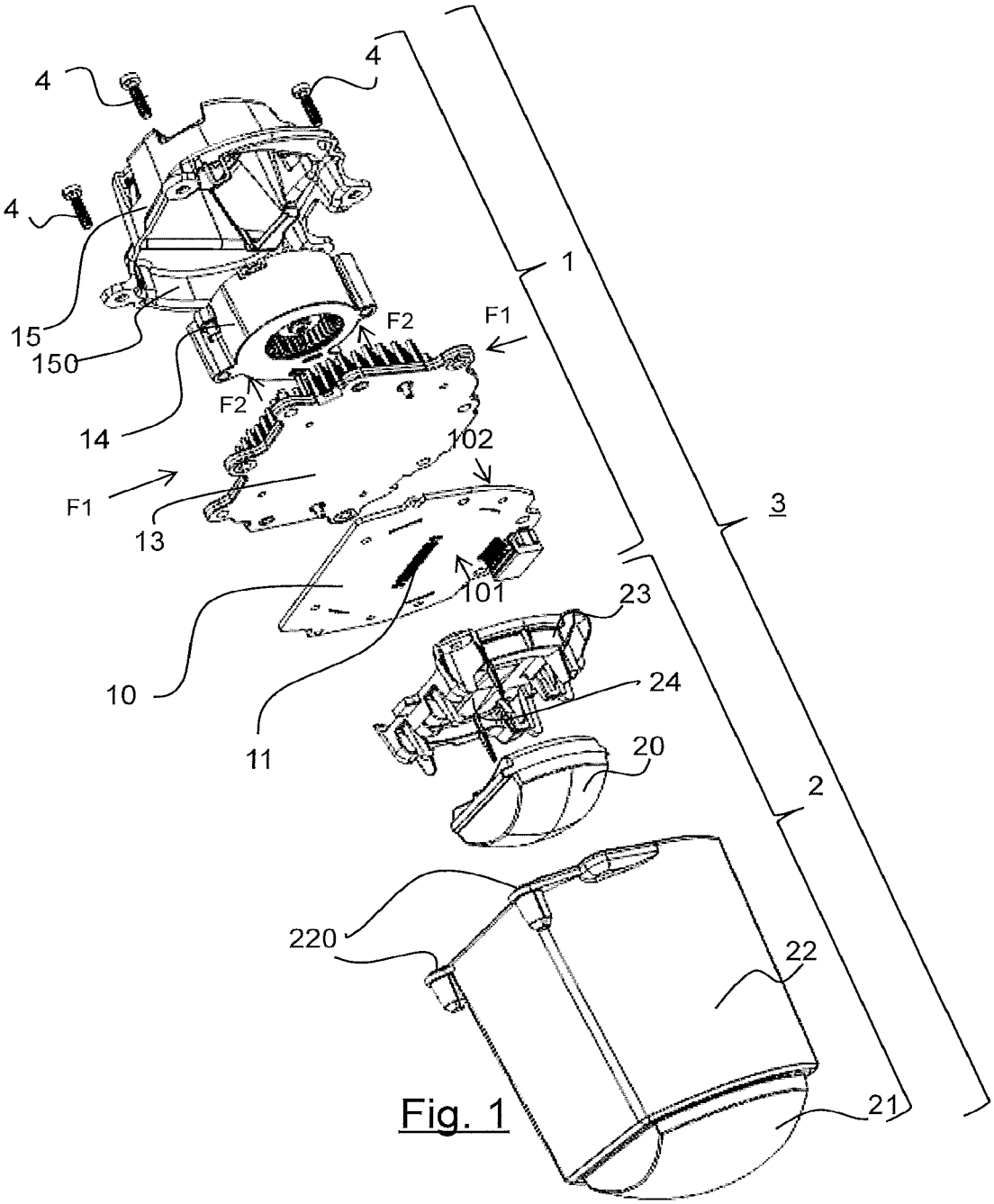
FIG. 1 represents an exploded view of a lighting module according to a first non-limiting embodiment of the invention, the said lighting module comprising a support plate, a plurality of sources of light, a heat dissipater, a fan, a plenum and an optical assembly.
Figure 2:
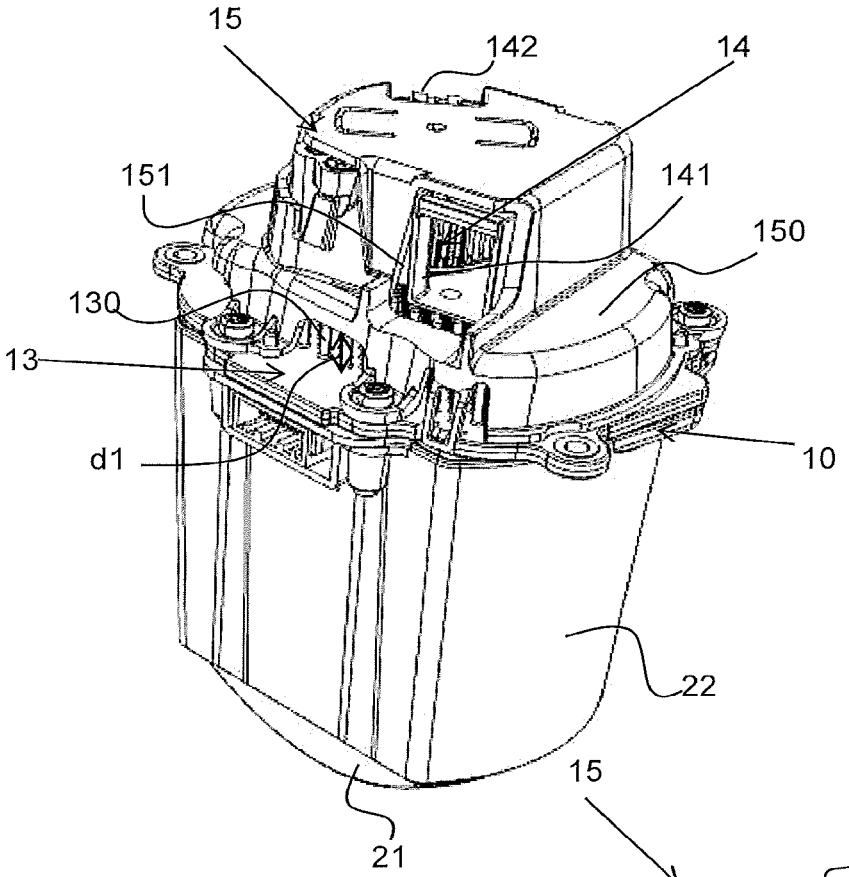
FIG. 2 represents a first view in perspective of the said lighting module in FIG. 1 assembled, according to a non-limiting embodiment.
Figure 3:
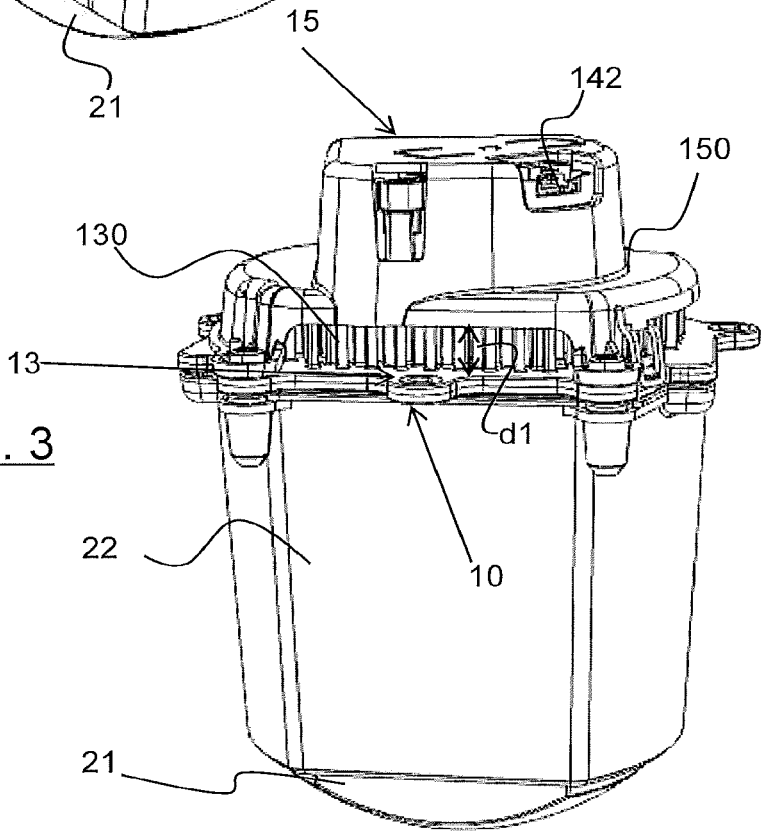
FIG. 3 represents a second view in perspective of the said lighting module in FIG. 1 assembled, according to a non-limiting embodiment.

As illustrated in FIGS. 1 to 3, the lighting module 3 comprises:

- a support plate 10;
- at least one source of light 11 arranged on a first face 101 of the said support plate 10;
- a heat dissipater 13 arranged on a second face 102 of the said support plate 10, opposite the said first face 101;
- a fan 14 arranged between the said heat dissipater 13 and a plenum 15, the said fan 14 being designed to aspirate a flow of hot air F2 dissipated by the said heat dissipater 13, and obtained from an incoming flow of air F1,
- a plenum 15 which is designed to cover the said fan 14, the said plenum 15 comprising a peripheral skirt 150 which is designed to surround the said heat dissipater 13;
- an optical assembly 2 which cooperates with rays of light (not illustrated) of the said at least one source of light 11, in order to produce a light beam (not illustrated).

As illustrated in FIG. 1, the elements 10, 11, 13, 14 and 15 form a lighting subassembly 1. The lighting subassembly 1 is a light generator and is known as the LAG (LED Assembly Group).

According to a non-limiting embodiment, as illustrated in FIG. 1, the optical assembly 2 comprises:

- a primary lens 24, which is designed to form light patterns from rays of light emitted by the sources of light 11;
- a support element 23;
- a secondary lens 20, also known as a correction lens, which is designed to correct the defects of the light patterns;

a projection lens 21 which is designed to project the said light patterns;

an intermediate element 22 between the said secondary lens 20 and the said projection lens 21.

Figure 4:
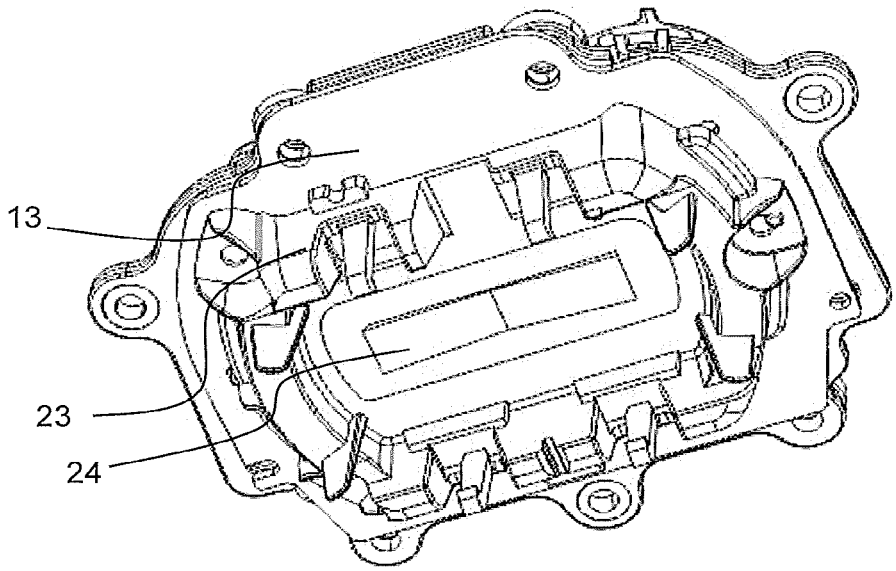
FIG. 4 represents a view in perspective of a lighting subassembly of the lighting module in FIG. 1, in which a support element and a primary lens are fitted, according to a non-limiting embodiment.
Figure 5:
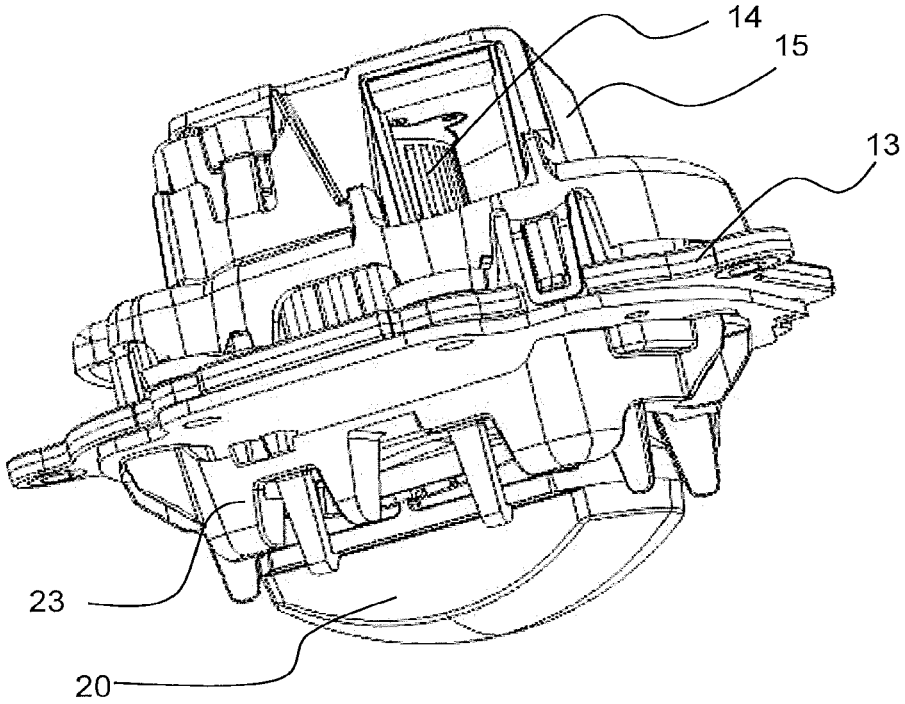
FIG. 5 represents a view in perspective of the lighting subassembly in FIG. 4, in which a secondary lens is also fitted, according to a non-limiting embodiment.

The support element 23 illustrated in FIGS. 1, 4 and 5 makes it possible to place the primary lens 24 on the support plate 10, and acts as a support for the secondary lens 20.

The intermediate element 22 acts as a housing for the lighting module 3. In particular, it makes it possible to cover the elements 14, 13, 10, 11, 23, 24 and 20. In addition, it makes it possible to retain the projection lens 21 in place, and prevents leakages of light. It is opaque. In addition, it makes it possible to secure the support plate 10, the heat dissipater 13 and the plenum 15 to one another by means of securing screws 4. For this purpose, according to a non-limiting embodiment, it comprises four securing orifices 220 (illustrated in FIG. 1) which are designed to receive four securing screws 4. It will be appreciated that it can comprise more or fewer securing orifices 220.

The elements of the lighting module 3 are described in detail hereinafter.

Support Plate 10

The support plate 10 is illustrated in FIGS. 1, and 6 to 8.

The support plate 10 is designed to receive:

at least one source of light 11 on a first face 101;

the heat dissipater 13 on a second face 102, opposite the first face 101.

According to a non-limiting embodiment, the support plate 10 comprises a plurality of sources of light 11. In particular, for the ADB Matrix Beam and DBL applications, according to a non-limiting example the support plate 10 comprises two lines of sixteen sources of light 11, one line being dedicated to the ADB Matrix Beam function, and the other line to the DBL function. It will be noted that a conventional lighting device providing only a conventional high-beam function comprises a lighting module formed only by four sources of light according to a non-limiting example.

According to a non-limiting embodiment, the support plate 10 is a printed circuit board known as PCBA (Printed Circuit Board Assembly).

According to a non-limiting embodiment, the support plate 10 additionally comprises electronic components for the electrical supply to the sources of light 11.

According to non-limiting embodiments, the support plate 10 comprises:

at least one securing orifice 104 (illustrated in FIGS. 6 to 8) designed to receive the securing screw 4 (illustrated in FIG. 1). According to a non-limiting example, it comprises four securing orifices 104. This makes it possible to secure the support plate 10 on the intermediate element 22. The support plate 10 is thus sandwiched between the heat dissipater 13 on one side and the intermediate element 22 on the other side;

at least one orifice 103 (illustrated in FIG. 6) for positioning of the heat dissipater 13, in which a positioning stud 133 can be inserted. According to a non-limiting example, the support plate 10 comprises two positioning orifices 103.

Figure 7:
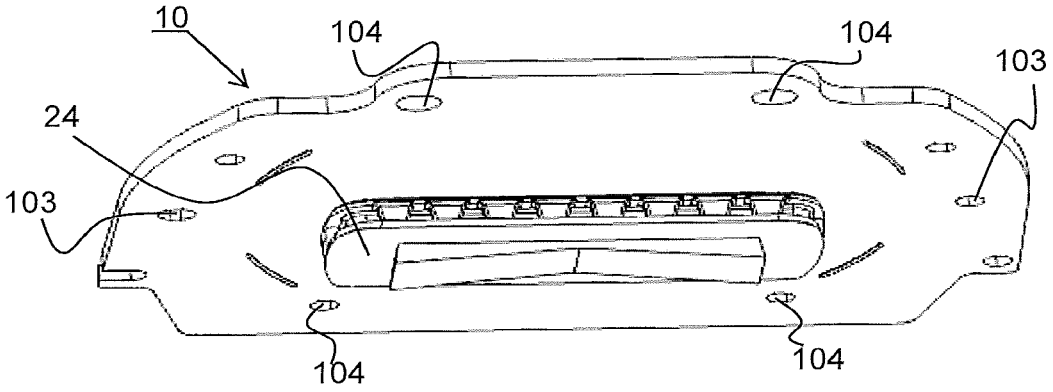
FIG. 7 represents the support plate in FIG. 6, on which a primary lens is installed.

As illustrated in FIG. 7, according to a non-limiting embodiment, the support plate 10 is designed to receive the primary lens 24 which covers the said plurality of sources of light 11.

Figure 8:
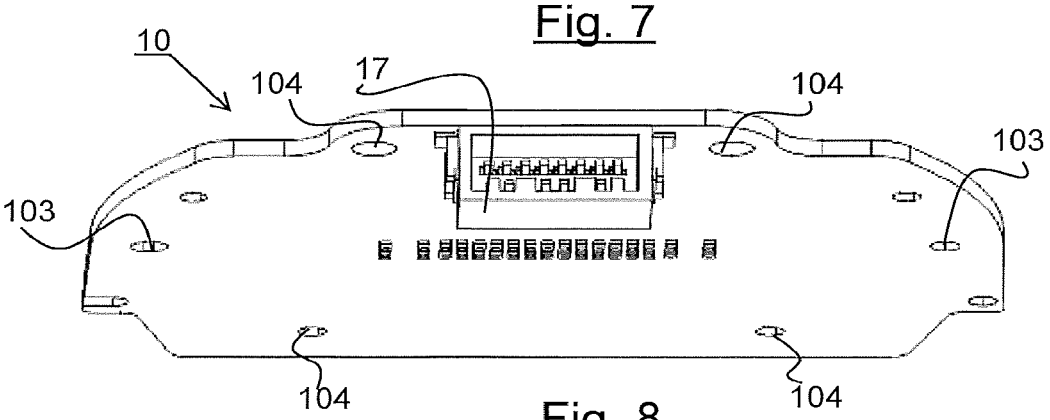
FIG. 8 represents the said support plate in FIG. 6, the said support plate additionally comprising a male connector.

As illustrated in FIG. 8, according to a non-limiting embodiment, the support plate 10 additionally comprises a male connector 17. This male connector 17 is designed to cooperate with a female connector of a cable bundle (not illustrated). The cable bundle makes it possible to convey a supply voltage from an electrical supply network such as a motor vehicle battery, and thus to supply the sources of light 11 of the support plate 10 with power.

Source of Light 11

Figure 6:
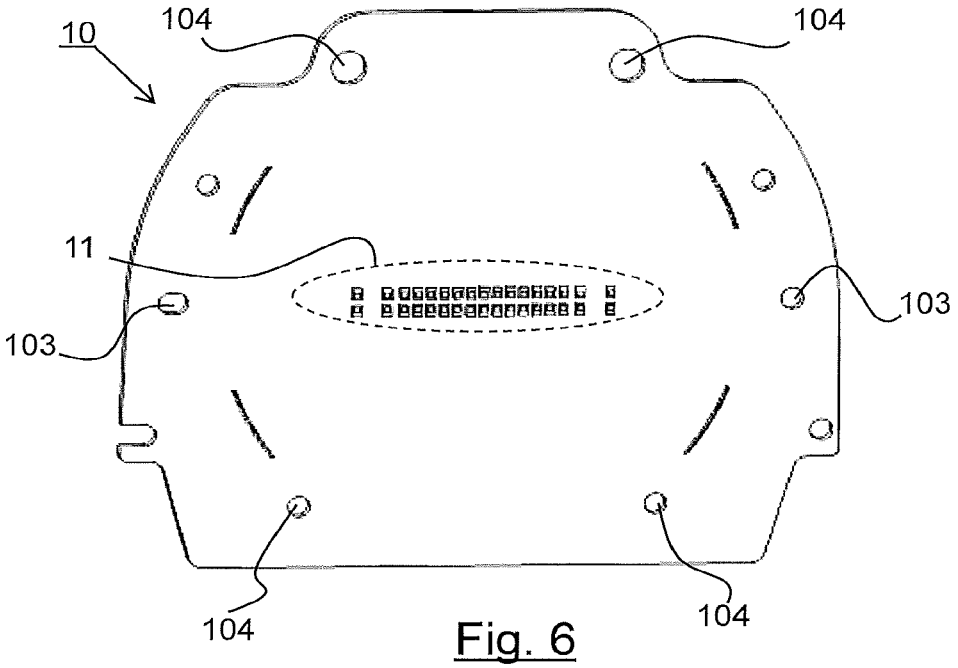
FIG. 6 is a view from below of the said support plate of the lighting module in FIGS. 1 to 5, in which lighting sources are arranged, according to a non-limiting embodiment.

The source of light is illustrated in FIGS. 1, 6 and 7.

A source of light 11 is designed to emit rays of light which cooperate with the primary lens 24.

According to a non-limiting embodiment, a source of light 11 is a semiconductor source of light, in particular a semiconductor emitting chip. According to a non-limiting variant embodiment, the semiconductor source of light forms part of a light-emitting diode. Light-emitting diode means any type of light-emitting diode, which in non-limiting examples can be LEDs (Light-Emitting Diodes), an OLED (Organic LED) an AMOLED (Active Matrix Organic LED) or FOLED (Flexible OLED).

According to a non-limiting embodiment, the source of light 5 is a monochromatic or RGB (for Red, Green, Blue) or RGBW (for Red, Green, Blue, White) source of light.

The sources of light 11 generate heat.

The heat dissipater 13 with the fan 14 and the plenum 15 will permit efficient dissipation of heat from the sources of light 11.

Heat Dissipater 13

The heat dissipater 13 is illustrated in FIGS. 1, 9 to 13*b* and 20.

It is designed to dissipate the heat given out by the sources of light 11.

Figure 9:
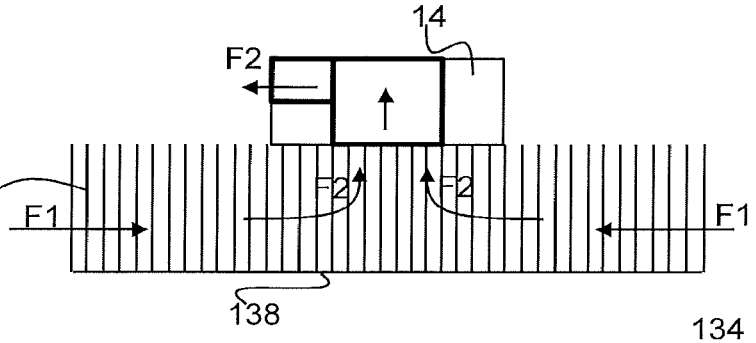
FIG. 9 represents a diagram of the heat dissipater and of the fan of the lighting module in FIG. 1, according to a non-limiting embodiment.

As illustrated in FIG. 9, from an incoming flow of air F1, the heat dissipater 13 will be able to dissipate the heat given out by the sources of light 11. A flow of hot air F2 from the incoming flow of air F1 is thus produced, and is then extracted by the fan 14 from the lighting module 3. The incoming flow of air F1 is the flow of air F1 surrounding the lighting module 3.

The heat dissipater 13 is arranged on the face 102 of the support plate 10 opposite that 101 on which the sources of light 11 are arranged. The heat dissipater 13 comprises a base 138.

According to a non-limiting embodiment, the heat dissipater 13 comprises a surface area which is substantially equal to that of the support plate 10, such as to cover its face 102 completely. This makes it possible to be certain of being able to dissipate the heat produced by all the sources of light 11, irrespective of their location on the support plate 10.

Figure 10:
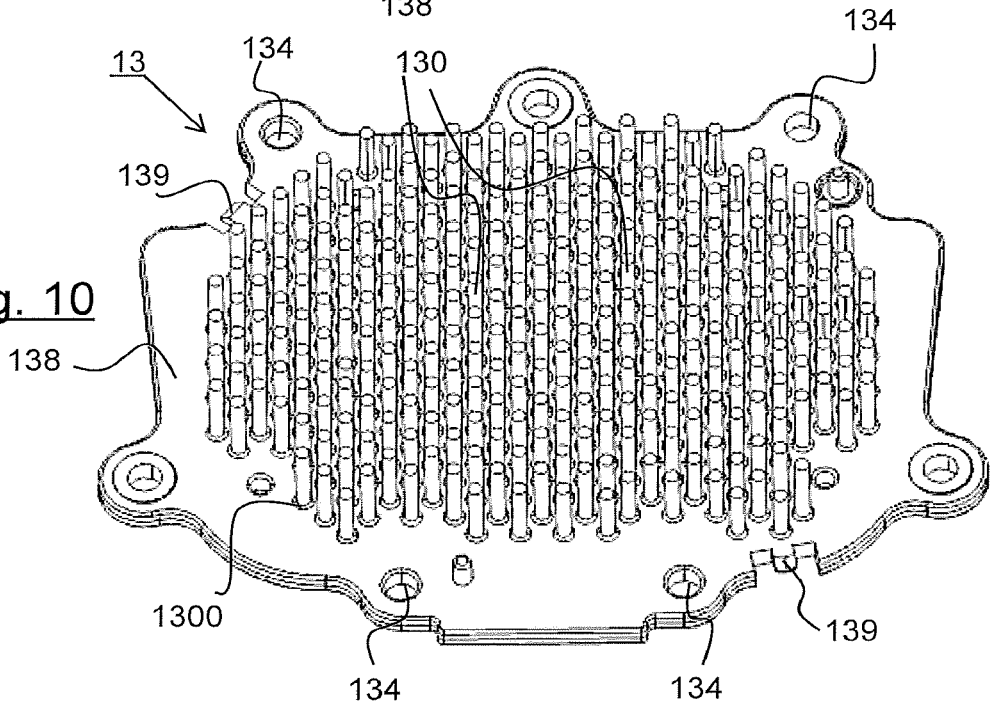
FIG. 10 represents a view from below of the heat dissipater of the lighting module in FIG. 1, with protuberances according to a first non-limiting embodiment.

As illustrated in FIGS. 9 to 13*b*, according to a non-limiting embodiment, the heat dissipater 13 comprises protuberances 130. The protuberances 130 will make it possible to increase the surface of the heat-exchange surface with the incoming flow of air F1 in comparison with a heat dissipater 13 without protuberances 130 where the heat-exchange surface is flat, i.e. where it is limited to the base 138 of the said heat dissipater 13. As illustrated in FIG. 10, the protuberances 130 extend from the base 138 of the heat dissipater 13. Thus, the base 1300 of the protuberances is supported on the said base 138 of the heat dissipater 13.

Figure 11:
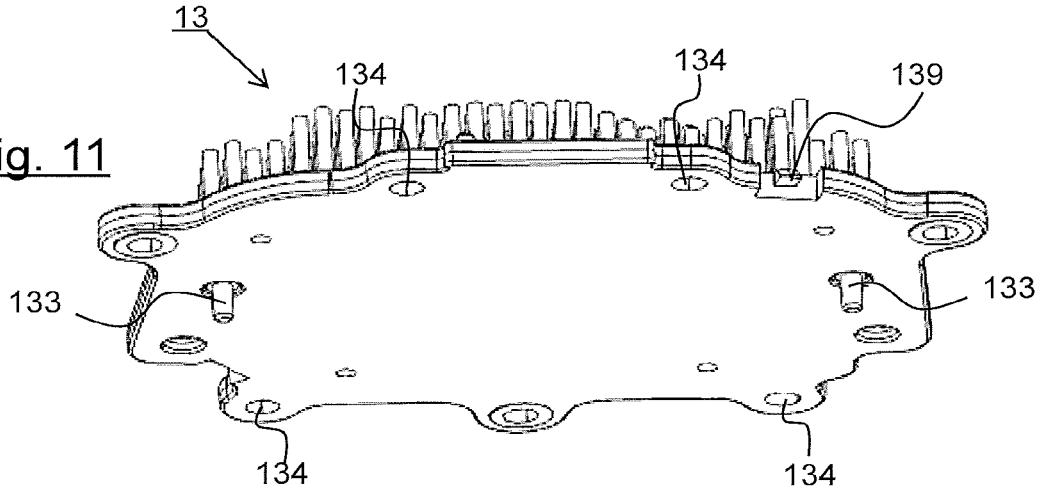
FIG. 11 represents a view from above of the heat dissipater in FIG. 10.

According to a first non-limiting embodiment illustrated in FIGS. 10 and 11, the protuberances 130 are pins.

Figure 12:
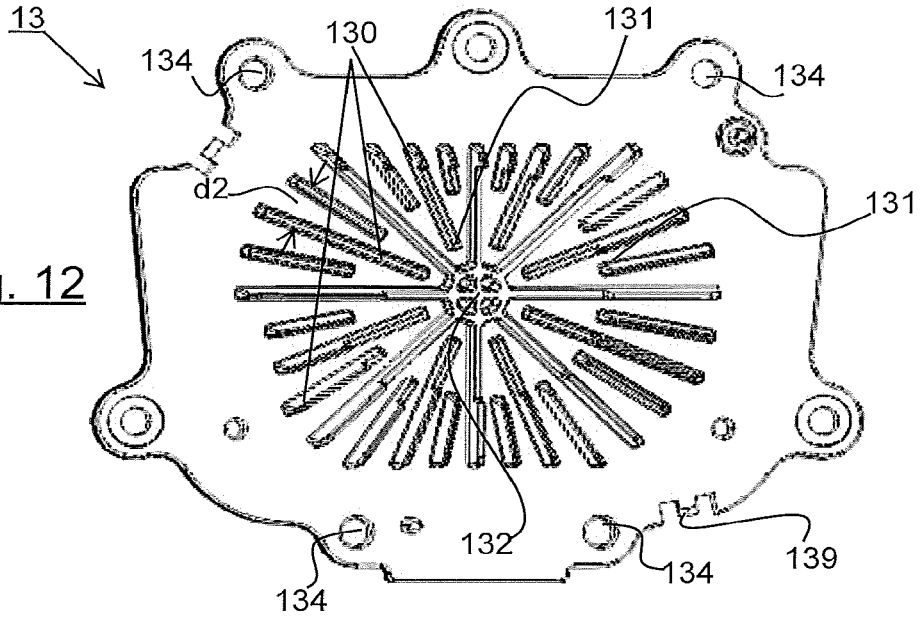
FIG. 12 represents a view from below of the heat dissipater of the lighting module in FIG. 1, but with protuberances according to a second non-limiting embodiment.

According to a second non-limiting embodiment illustrated in FIG. 12, the protuberances 130 are fins. According to a variant non-limiting embodiment, the fins 130 form a star, i.e. the fins 130 are projecting ribs comprising an end 131 which is oriented towards a single central point 132 of the said heat dissipater 13. This form of the protuberances 130 and the arrangement in the form of a star makes it possible to obtain a more laminar flow of air then in the case of the pins. There is thus less turbulence. It will be noted that the section d2 between two fins 130 is not constant. It decreases going towards the central point 132. The speed of the incoming flow of air F1 thus tends to increase when it reaches the central point 132, and to be lower at the beginning. It will be noted that, in this case, there is a loss of performance in terms of the extraction of the heat in comparison with the third embodiment described hereinafter.

It will be remembered that the flow of air (in $m^3/s$) is equal to the speed of passage (in m/s) multiplied by the cross-section of passage (in $m^2$) between two protuberances 130, and that, for a given flow of air, the smaller the cross-section of passage, the greater the speed.

Figure 13A:
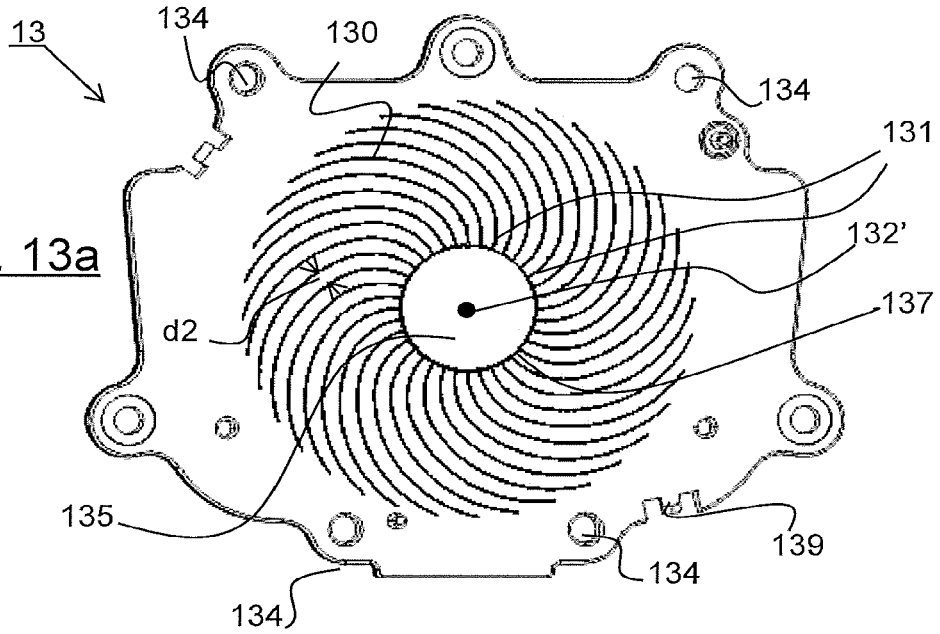
FIG. 13*a* represents a view from below of the heat dissipater of the lighting module in FIG. 1, but with protuberances according to a third non-limiting embodiment.

According to a third non-limiting embodiment illustrated in FIG. 13*a*, the protuberances 130 are portions of an ellipse which are parallel to one another, i.e. blades in the form of a portion of ellipse. According to a non-limiting variant embodiment, the protuberances 130 form a spiral. The heat dissipater 13 comprises a central chamber 135 arranged in the centre of the heat dissipater 13, from which the said portions of ellipses 130 extend. It will be noted that the ends 131 of the portions of ellipses 130 which open onto the central chamber 135 form a virtual circle 137.

This third embodiment makes it possible to have a larger heat-exchange surface with an incoming flow of air E1 than in the first and second embodiments.

It will be noted that, the more the length of a portion of ellipse 130 is increased, the more the contact surface between the incoming flow of air F1 and the heat dissipater 13 increases, which makes it possible to increase the heat-exchange surface, and thus the dissipation of heat. According to a variant of this third embodiment illustrated, the section d2 between two adjacent portions of ellipse is constant. This makes it possible to have a constant speed of the incoming flow of air F1 which comes into contact with the portions of ellipse 130. Good performance is obtained in terms of extraction of heat, the said extraction being the same from the beginning of the portion of ellipse 130. This embodiment makes it possible to have more high-performance dissipation of heat than in the first and second embodiments.

According to a variant of this third embodiment illustrated in FIG. 13*b*, the heat dissipater 13 comprises a profiled conical form 132' arranged below the fan 14. This profiled conical form 132' is arranged in the central chamber 135 substantially in the centre. This makes it possible to have a laminar flow of the flow of hot air F2 (from the incoming flow of air F1) in the central chamber 135, without having turbulence or eddying. This assists the ascending of the flow of hot air F2 to the fan 14. This therefore decreases the loss of load of the said flow of hot air F2. It will be noted that this variant embodiment can also be applied to the first embodiment (pins) and second embodiment (fins).

According to non-limiting embodiments, the heat dissipater 13 also comprises at least:

- a securing orifice 134 (illustrated in FIGS. 10 to 13*a*) designed to receive a securing screw 4 (illustrated in FIG. 1). According to a non-limiting example, it comprises four securing orifices 134. This makes it possible to secure the heat dissipater 13 on the intermediate element 22;
- at least one positioning stud 133 (illustrated in FIG. 11) designed to be inserted in the positioning orifices 103 previously described of the support plate 10. According to a non-limiting example, it comprises two positioning pins 133;
- at least one notch 139 (illustrated in FIG. 10) designed to secure the plenum 15 on the said heat dissipater 13. According to a non-limiting example, it comprises two notches 139.

Fan 14

The fan 14 is illustrated in FIGS. 1, 9 and 13*b* to 15.

The fan 14 is arranged between the heat dissipater 13 and the plenum 15. It is arranged axially.

It is a centrifugal fan: it is therefore designed to aspirate a flow of air.

Figure 13B:
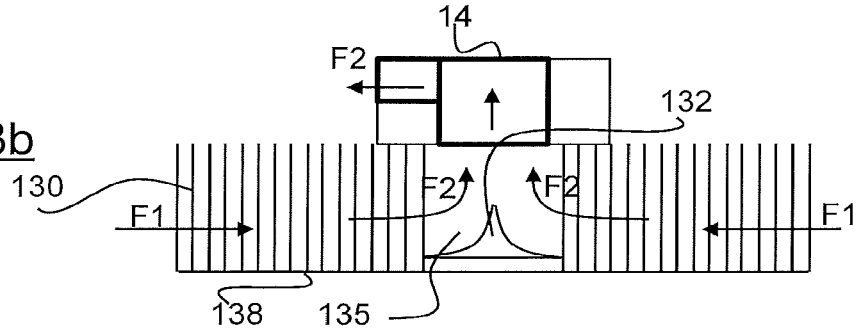
FIG. 13*b* is a diagram of the heat dissipater in FIG. 13*a* seen in profile, according to a first non-limiting embodiment.

As illustrated in FIG. 9 or FIG. 13*b*, the fan 13 is designed to aspirate the flow of hot air F2 from the incoming flow of air F1 which is dissipated by the heat dissipater 13. It thus extracts the flow of hot air F2 which circulates in the heat dissipater 13, in order to discharge it outside the lighting module 3.

Contrary to the fact of blowing on the heat dissipater 13, the fact of aspirating the flow of hot air F2, and thus of extracting it from the lighting module 3, will also make it possible to recuperate and reuse this flow of hot air F2 in order:

- in the non-limiting embodiment described, to cool the second lighting module (which provides the photometric function of a high beam with a low beam) arranged adjacent to the lighting module 3; and
- to defrost or demist the front outer lens of the lighting device.

Figure 14:
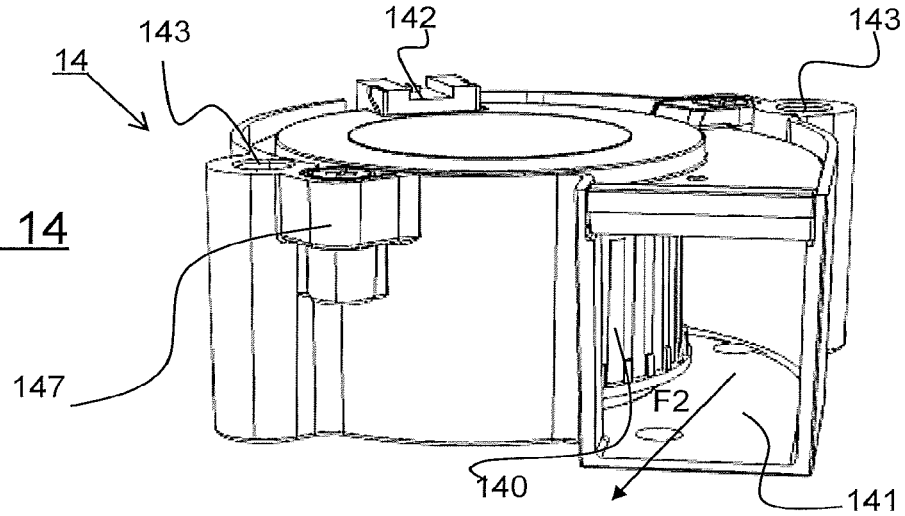
FIG. 14 is a first view in perspective of the lighting module in FIG. 1, according to a first non-limiting embodiment.
Figure 15:
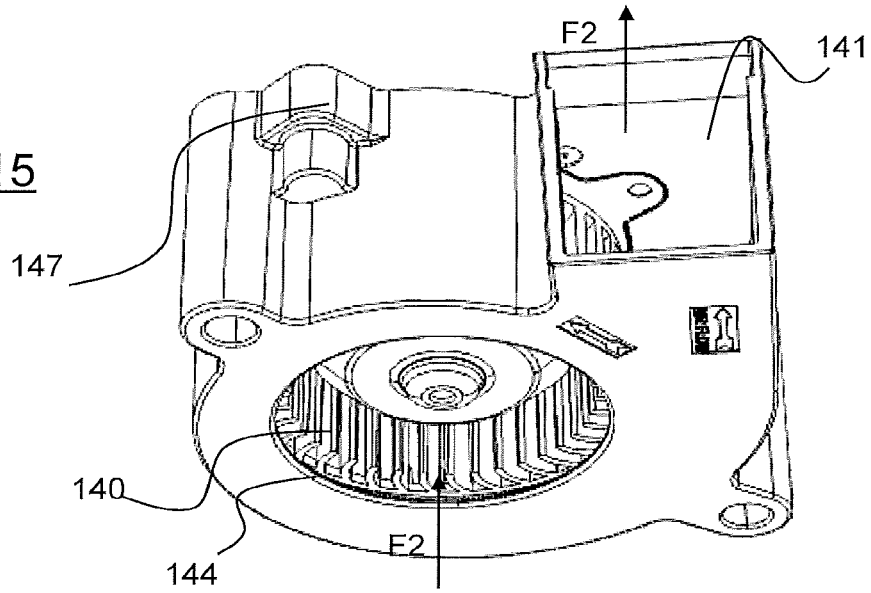
FIG. 15 is a second view in perspective of the fan in FIG. 14, according to a first non-limiting embodiment.

As illustrated in FIGS. 14 and 15, the fan 14 comprises:

- a centrifugal wheel 140 which is designed to aspirate the said flow of hot air F2 produced by the dissipation of heat of the heat dissipater 13, and to expel it outside the lighting module 3 (in particular outside the light generator 1) via an air duct 141;
- an open base 144 via which the flow of hot air F2 aspirated by the centrifugal wheel 140 can be engulfed. This open base 144 is positioned opposite the heat dissipater 13 on the side of its protuberances 130. According to the non-limiting embodiment illustrated, the flow of hot air F2 is thus aspirated axially;
- the said air duct 141 via which the said flow of hot air F2 is extracted. The outlet of the air duct 141 is arranged opposite a lateral air outlet 152 of the plenum 15. According to the non-limiting embodiment illustrated, the air duct 141 is lateral. The flow of hot air F2 is thus discharged laterally from the lighting module 3 (in particular from the light generator 1);
- a supply connector 142 which is designed to be connected to a supply in order to supply power to the said fan 14;
- at least one positioning orifice 143 for the said plenum 15. This orifice is designed to receive a positioning stud 153 of the plenum 15. In the non-limiting example illustrated, there are two positioning orifices 153.

As illustrated in FIG. 15, the fan 14 also comprises:

- at least one projecting part 147, which is designed to block the plenum 15. The said at least one projecting part 147 is designed to cooperate with a tongue 157 of the plenum 15 described hereinafter. According to a non-limiting example, there are two projecting parts 147.

Plenum 15

Figure 19:
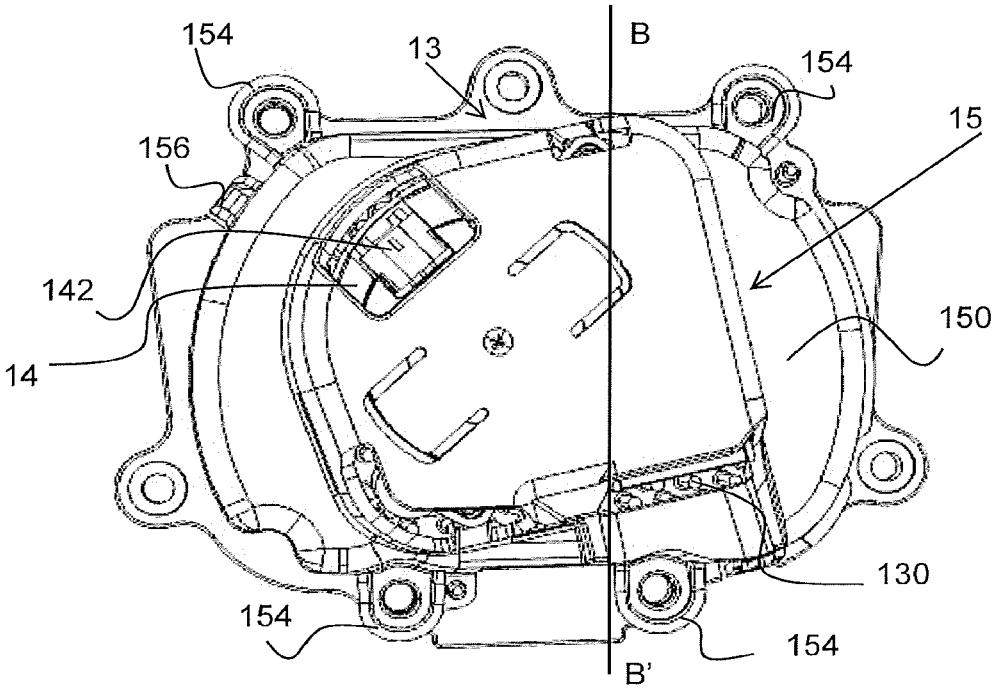
FIG. 19 is a view from above of the plenum in FIGS. 16 to 18.
Figure 20:
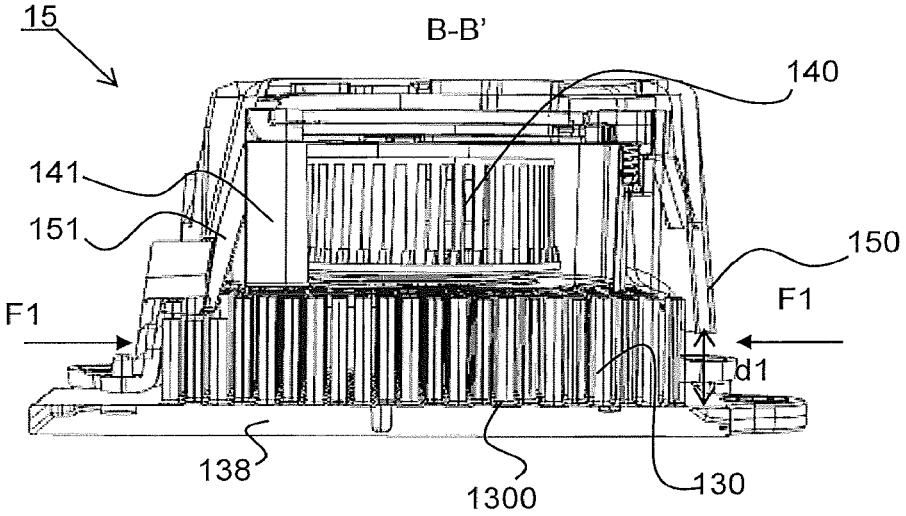
FIG. 20 is a view in cross-section according to an axis B-B' of the plenum in FIGS. 16 to 19.
Figure 22:
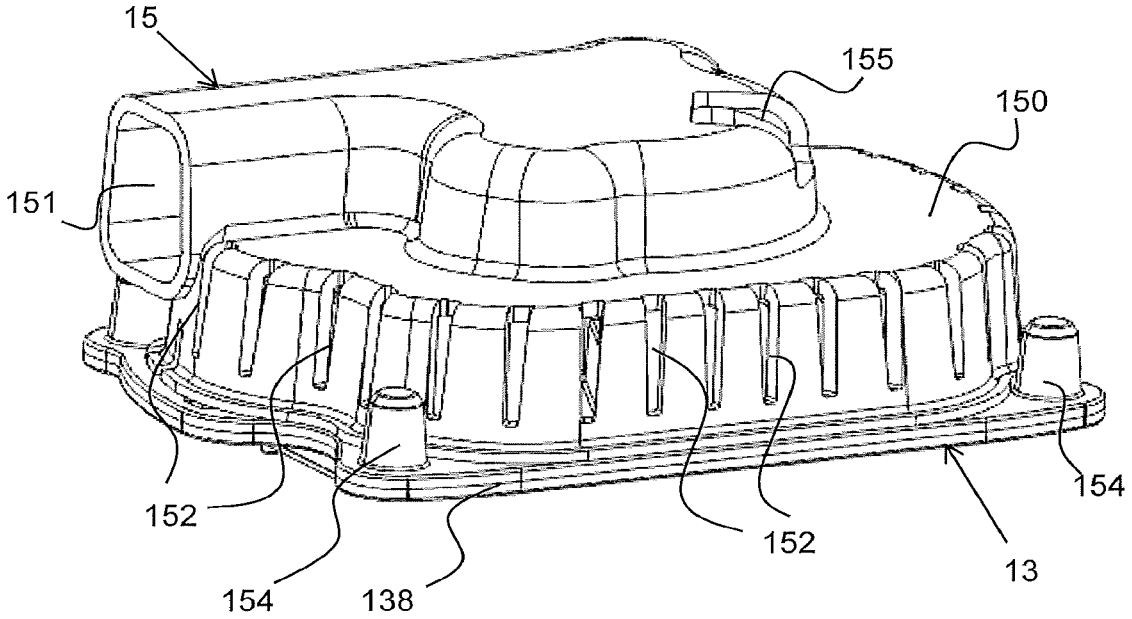
FIG. 22 is a view in perspective of the lighting module in FIG. 21 without the optical assembly.
Figure 21:
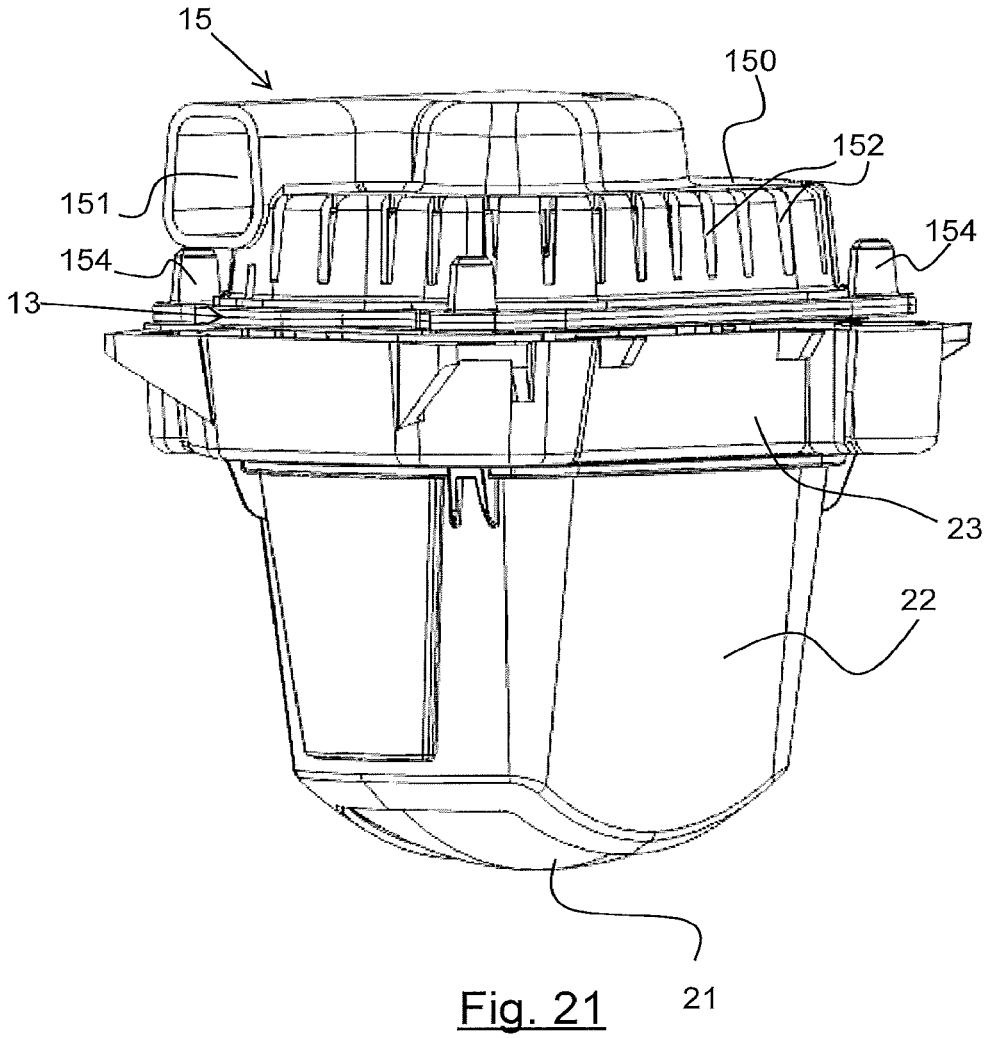
FIG. 21 is an assembled view in perspective of a lighting module according to a second non-limiting embodiment of the invention, the said lighting module comprising a support plate, a plurality of sources of light, a heat dissipater, a fan, a plenum and an optical assembly.
Figure 23:
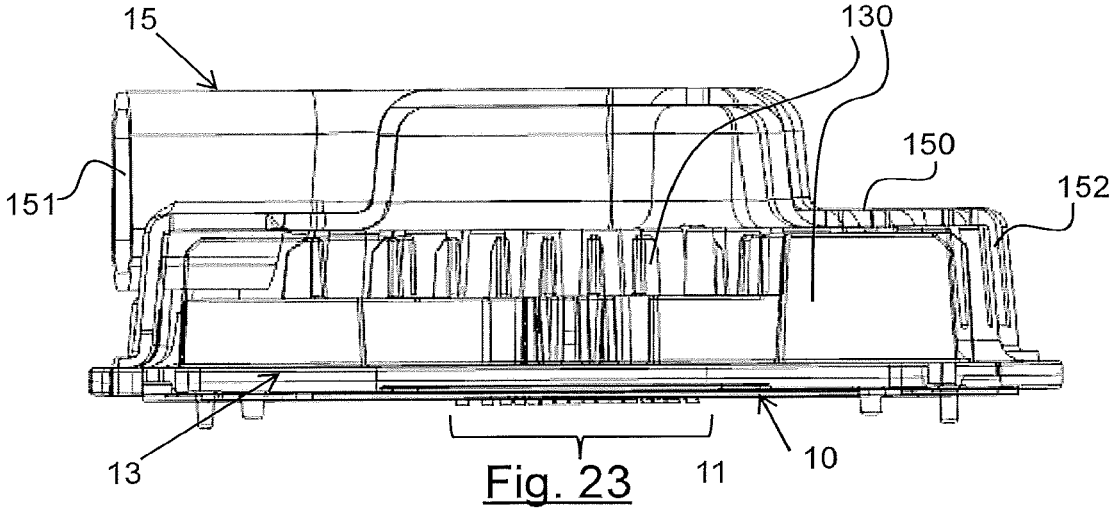
FIG. 23 is a view in cross-section of the lighting module in FIG. 21, without the optical assembly and without the fan.

The plenum 15 (also known as the shell) is illustrated in FIGS. 1 and 16 to 20 according to a first non-limiting embodiment, and in FIGS. 21 to 23 according to a second non-limiting embodiment.

The plenum 15 is designed to be arranged on the fan 14 and to cover it as illustrated in FIGS. 19 and 20.

The plenum 15 makes it possible:

- to force the incoming flow of air F1 to pass through a heat-exchange surface (the base 138 and/or the protuberances 130);
- to confine the incoming flow of air F1 around the heat dissipater 13, in particular around the protuberances 130, such as to force it to circulate around the protuberances 130 for as long as possible in order to increase the dissipation of heat;
- to force the incoming flow of air F1 to circulate also at the periphery of the heat dissipater 13, such that the protuberances 130 at the periphery are also well cooled by this incoming flow of air F1. Thus, the incoming flow of air F1 is not directed at once to the centre of the heat dissipater 13 in order to be aspirated by the fan 14;
- to control the flow and the speed of passage as well as the direction of the incoming flow of air F1 thanks to the air inlets 152 (described hereinafter) and/or to the distance d1 (described hereinafter) between the peripheral skirt 150 and the base 138 of the heat dissipater 13;
- to generate sufficient pressure on the incoming flow of air F1 and thus to generate a sufficient pressure on the flow of hot air F2 from the flow of air F1, thus facilitating its extraction by the fan 14. The greater the pressure, the greater the speed of the flow of the incoming air F1, and thus the greater the flow of hot air F2 will be, and the easier the extraction;
- for the incoming flow of air F1 to be in contact with a larger heat-exchange surface, represented by the base 138 of the heat dissipater 13 and/or the protuberances 130 of the heat dissipater 13, before the fan 14 aspirates the flow of hot air F2 from the incoming flow of air F1 and extracts it from the lighting module 3 (and in particular from the light generator 1).

Peripheral Skirt 150

The plenum 15 comprises a peripheral skirt 150 which is designed to surround the heat dissipater 13 as illustrated in FIG. 20 or 23. In particular, as illustrated in FIG. 20 or 23, the peripheral skirt 150 is designed to surround the protuberances 130 of the said heat dissipater 13 when it comprises protuberances 130 of this type. This embodiment with the protuberances 130 is adopted in a non-limiting example in the continuation of the description.

First Embodiment

According to a first non-limiting embodiment illustrated in FIGS. 2, 3, and 16 to 20, the peripheral skirt 150 is designed to descend as far as a distance d1 from the base 138 of the heat dissipater 13, i.e. as far as a distance d1 from the base 1300 of the said protuberances 130.

In this case, the peripheral skirt 150 covers the heat dissipater 13. It is solid, i.e. it does not comprise any air inlet 152.

Figure 16:
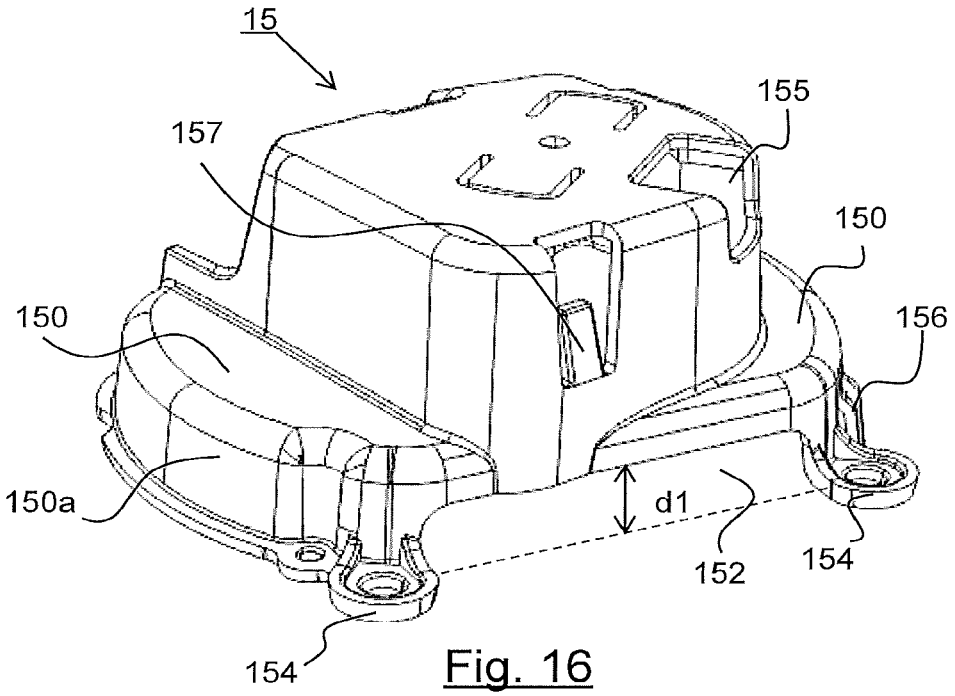
FIG. 16 is a first view in perspective of the plenum of the lighting module in FIG. 1, according to a first non-limiting embodiment, the said plenum comprising a peripheral skirt without an air inlet.
Figure 17:
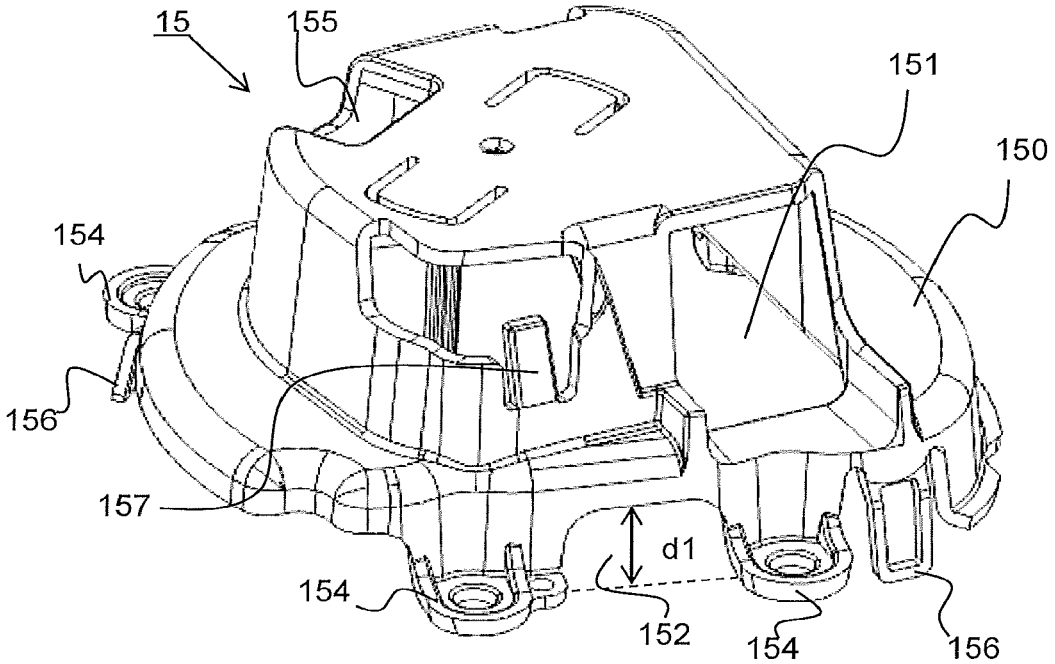
FIG. 17 is a second view in perspective of the plenum in FIG. 16.
Figure 18:
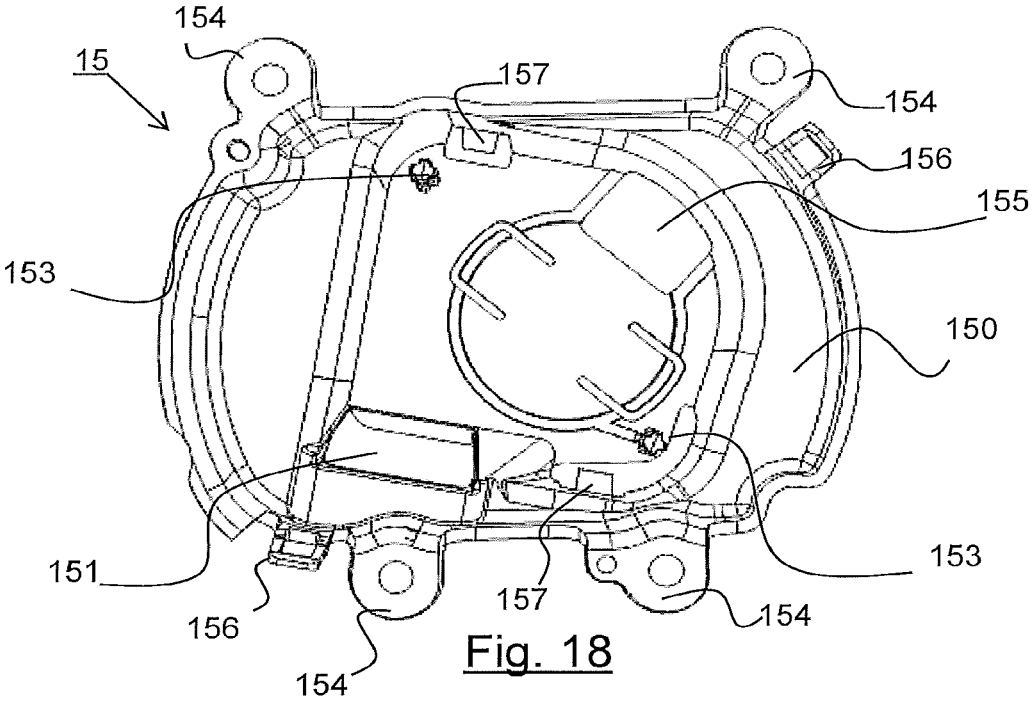
FIG. 18 is a view from below of the plenum in FIGS. 16 and 17.

As can be seen in FIG. 20, there is a distance d1 between the base 138 of the heat dissipater 13 and the peripheral skirt 150. This makes it possible to define a corresponding space at air inlets 152 delimited by the base of the peripheral skirt 150 and the base 138 of the heat dissipater 13, which air inlets 152 do not form part of the peripheral skirt 150, as illustrated in FIGS. 16 and 17 for example. Thus, the plenum 15 is configured such as to delimit the said air inlets 152. This allows an incoming flow of ambient air F1 to pass below the peripheral skirt 150 via the said air inlets 152, and to come into contact with the base 138 and the protuberances 130 of the heat dissipater 13, and to cool them. In particular, the incoming flow of air F1 will cool the protuberances 130 from the bottom upwards, with the incoming flow of air F1 rising to the top of the plenum 15 by means of the aspiration force of the fan 14, thus improving the dissipation of heat.

According to a non-limiting variant embodiment illustrated, the peripheral skirt 150 descends partly as far as the distance d1 of the base 138, with another part 150*a* (illustrated in FIG. 17) of the peripheral skirt 150 descending as far as the base 138 of the heat dissipater. In this case, the peripheral skirt 150 covers the heat dissipater 13 only partly. This non-limiting variant embodiment makes it possible to adapt to the integration of the lighting module 3 (in particular of the light generator 1) in the lighting device, such as to avoid any recirculation of the flow of hot air F2 in the said lighting module 3 (in particular in the said light generator 1). This non-limiting variant embodiment makes it possible to prevent or at least to limit air heated by a component outside the module from entering the plenum 15. This ensures the cooling of the module by controlling the air inlet into the plenum 15 while limiting the already heated air inlets. Indeed, this non-limiting variant embodiment allows to choose the source of the air entering the plenum 15 by choosing the position of the air inlets 152 so that they are placed only where the air has not already been heated by another component. The peripheral skirt 150 is then descended as far as the base 138 of the heat dissipater in the zones where the air has already been heated so that this heated air does not enter the plenum 15.

Second Embodiment

According to a second non-limiting embodiment illustrated in FIGS. 21 to 23, the peripheral skirt 150 is designed to descend substantially as far as the base 138 of the heat dissipater 13, i.e. as far as the base 1300 of the protuberances 130 of the said heat dissipater 13. In this case, the peripheral skirt 150 covers the heat dissipater 13 completely. It comprises air inlets 152, such that a flow of incoming ambient air F1 can enter via these air inlets 152, and reach as far as the base 138 and as far as the protuberances 130 of the heat dissipater 13, and cool them. According to a non-limiting variant embodiment illustrated, these air inlets 152 are lateral, and extend substantially along the entire height of the peripheral skirt 150. They are arranged opposite the protuberances 130. By this means, the protuberances 130 are cooled along their entire height from the bottom upwards, with the incoming flow of air F1 rising to the top of the plenum 15 by means of the aspiration force of the fan 14, thus improving the dissipation of heat.

According to the two non-limiting embodiments, the air inlets 152 or the distance d1 are configured according to the capacity of the fan 14 to aspirate a flow of air. It will be noted that the smaller the cross-section of the air inlets 152 or the smaller the distance d1, the greater the pressure of the incoming flow of air F1 into the plenum 15, and the greater its speed of passage. It will be remembered that the flow of air of the fan 14 depends on the pressure generated by the cross-section of an air inlet 152 (or the distance d1).

The air inlets 152 or the distance d1 are configured such that the pressure generated on the incoming flow of air F1 depends on the flow of air of the fan 14, i.e. the flow of air which the fan 14 can aspirate. It will be noted that a curvature is provided by the supplier of the fan, establishing the flow of the fan according to the pressure exerted on a flow of air. If the pressure is too great, it may be difficult for the fan 14 to aspirate the flow of hot air F2 from the incoming flow of air F1.

Thus, the dimensions of the air inlets 152 or of the distance d1 will depend on:

the speed of the incoming flow of air F1 and the direction of the incoming flow of air F1 to be obtained between the protuberances 130 of the heat dissipater 13; and the fan 14.

According to a non-limiting embodiment, the speed of the incoming flow of air F1 to be obtained is substantially greater than, or equal to, 2 m/s (metres/second) between the protuberances 130, which makes it possible to obtain good cooling of the sources of light 11. Beyond that, the dissipation of heat is too low.

The dimensions of the air inlets 152 or of the distance d1 thus makes it possible to control the passage of the incoming flow of air F1 into the plenum 15, and which air thus reaches the heat dissipater 13.

It will be noted that the air inlets 152 are positioned according to the integration of the lighting module 3 (in particular of the light generator 1) in the lighting device, such as to avoid any recirculation of the flow of hot air F2 into the lighting module 3 (in particular into the said light generator 1).

Air Outlet 151

According to a non-limiting embodiment illustrated in FIGS. 17 to 23, the plenum 15 additionally comprises an air outlet 151 designed to permit the discharge of the flow of hot air F2 which is produced by the dissipation of heat from the lighting module 3, and is aspirated by the fan 14. This air outlet 151 is arranged opposite the air duct outlet 141 of the fan 14, such that the flow of hot air F2 aspirated by the fan 14 circulates in the air duct 141 as far as the air outlet 151. According to a non-limiting embodiment, this air outlet 151 is oriented in the direction of the second lighting module (which provides the photometric function of a high beam with a low beam) in order to cool it. In fact, with the flow of hot air F2 which is extracted by the fan 14, a current of air is created towards the heat dissipater of the second lighting module, which makes it possible to drive out the hot air which has accumulated there (because of the dissipation of heat) above the heat dissipater of the said second lighting module. Thus, it is not necessary to use another fan for the second lighting module, which reduces the cost and the weight of the lighting device assembly comprising the lighting module 3 and the adjacent second lighting module.

According to a non-limiting embodiment, the flow of hot air F2 can also be directed (via an air guide not illustrated) in the direction of the front outer lens of the lighting device, in order to defrost it and/or eliminate the condensation on the said front outer lens. A current of hot air is thus obtained which permits defrosting and prevents condensation.

Thus, the plenum 15 with the heat dissipater 13 and the fan 14 permits cooling of the lighting module 3 (in particular of the light generator 1) comprising the sources of light 11, but also permits cooling of the second lighting module arranged adjacent to the lighting module 3. Thus, with the plenum 15, a single source of ventilation forced onto the lighting model 3 and a single heat dissipater 13, it is possible to cool two lighting modules of the lighting device in a given space.

Securing Devices 154, 156, Blocking Device 157

According to some non-limiting embodiments, the plenum 15 additionally comprises:

at least one device 154 for primary securing (illustrated in FIGS. 16 to 19, and 20 and 21) for primary securing on the intermediate element 22. According to a non-limiting embodiment, this primary securing device 154 is a securing lug with an orifice which is designed to receive a securing screw 4. According to a non-limiting example illustrated, there are four securing lugs 154;

at least one secondary securing device 156 (illustrated in FIGS. 16 to 19) on the heat dissipater 13. According to a non-limiting embodiment, this secondary securing device 156 is a securing clip, which is hooked onto a notch 139 of the heat dissipater 13. According to a non-limiting example illustrated, there are two securing clips 156. It will be noted that this secondary securing device 156 also applies for FIGS. 22 to 23, although it is not illustrated in the said figures;

at least one blocking device 157 (illustrated in FIGS. 16 to 18) on the fan 14. According to a non-limiting embodiment, this blocking device 157 is a tongue which moves away when the plenum 15 is arranged on the fan 14, then exerts a force on the fan 14, such as to clamp it and retain it in position in the plenum 15. This tongue 157 is blocked by the projecting part 147 of the fan 14. According to a non-limiting example illustrated, there are two tongues 157. It will be noted that this blocking device 157 also applies for FIGS. 22 to 23, although it is not illustrated in the said figures.

According to a non-limiting embodiment, the plenum 15 additionally comprises at least one opening 155 (illustrated in FIGS. 17, 18 and 22) which is designed to allow the connector 142 of the fan 14 to pass through.

It will be appreciated that the description of the invention is not limited to the embodiments described above.

Thus, according to another non-limiting embodiment, the air inlets 152 are situated at the top of the plenum 15.

Thus, according to another non-limiting embodiment, the heat dissipater 13 does not comprise any protuberances 130. It thus comprises a flat surface. Its base 138 acts as a heat-exchange surface in order to dissipate the heat given out by the sources of light 11.

Thus, according to another non-limiting embodiment, the heat dissipater 13 comprises protuberances 130 which are a combination of pins, fins and/or portions of ellipse.

Thus, according to another non-limiting embodiment, the lighting device comprises only a single lighting module which is designed to provide a photometric function of a high beam and/or a low beam. Thus, for example, the lighting module 3 is also designed to provide the photometric function of a low beam, and the lighting device does not comprise a second lighting module. Thus, the lighting module 3 is bifunctional.

Thus, according to another non-limiting embodiment, the lighting module 3 need not provide a DBL function.

Thus, according to another non-limiting embodiment, the lighting module 3 can provide only the photometric function of a low beam, and the second lighting module can provide only the photometric function of a high beam.

Thus, according to another non-limiting embodiment, the lighting module 3 can be bifunctional and the second lighting module can be bifunctional. In these cases, the light beams of the lighting module 3 and of the second lighting module are superimposed.

It will be noted that any other combination can be envisaged for the lighting device.

Thus, the invention described has the following advantages in particular:

thanks to the plenum 15, it makes it possible to cool a lighting module 3 more efficiently by controlling the passage of the incoming flow of air F1, contrary to a solution without a plenum 15;

it makes it possible to cool two lighting units arranged side-by-side in a single lighting device, thanks to the air outlet 151 of the plenum 15 and to the fan 14 which aspirates the flow of hot air F2 in order to extract it;

it avoids the use of air ducts;

it optimises the extraction of the flow of hot air F2 by the fan 14;

by means of the fan 14, it makes it possible to obtain forced ventilation which allows the flow of hot air F2 to be extracted rapidly;

it makes it possible to use the flow of hot air F2 to defrost or de-mist the front outer lens of the lighting device;

it makes it possible to cool efficiently a lighting device which comprises additional functionalities in comparison with a conventional lighting device, and which thus comprises a larger number of sources of light, consequently giving out more heat.

The invention claimed is:

1. A lighting module for a motor vehicle, the lighting module comprising:

a printed circuit board assembly (PCBA) support plate;

at least one source of light which is in direct contact with a first face of the support plate;

a heat dissipater which is arranged on a second face of the support plate, opposite the first face, the heat dissipater comprising a base;

a fan sandwiched between the heat dissipater and a plenum, the fan being designed to aspirate a flow of hot air which is dissipated by the heat dissipater, and is obtained from an incoming flow of air; and an optical assembly which cooperates with rays of light of the at least one source of light, in order to produce a light beam, wherein the plenum is configured to cover the fan, the plenum including a peripheral skirt which is designed to surround the heat dissipater and covers partly the heat dissipater, and the peripheral skirt descending as far as a distance from a base of the peripheral skirt to the base of the heat dissipater in a first location and descending as far as the base of the heat dissipater in a second location, wherein the base of the heat dissipater is separate from the support plate, the base of the heat dissipater in its entirety being in direct contact with the second face of the support plate, and protuberances extending from the base of the heat dissipater, the protuberances being in direct contact with the base.

2. The lighting module according to claim 1, wherein the peripheral skirt is solid.

3. The lighting module according to claim 1, wherein air inlets are defined between the base of the peripheral skirt and the base of the heat dissipater.

4. The lighting module according to claim 3, wherein air inlets are lateral.

5. The lighting module according to claim 1, wherein the plenum additionally comprises a lateral air outlet which is designed to discharge the flow of hot air aspirated by the fan.

6. The lighting module according to claim 1, wherein the protuberances of the heat dissipater are pins.

7. The lighting module according to claim 1, wherein the protuberances of the heat dissipater are fins.

8. The lighting module according to claim 7, wherein the fins comprise an end which is oriented towards a single central point of the heat dissipater.

9. The lighting module according to claim 1, wherein the protuberances of the heat dissipater are portions of an ellipse which are parallel to one another.

10. The lighting module according to claim 1, wherein the heat dissipater additionally comprises a profiled conical form which is arranged substantially below the fan.

11. The lighting module according to claim 1, wherein a source of light is a semiconductor source of light.

12. The lighting module according to claim 11, wherein a semiconductor source of light forms part of a light-emitting diode.

13. A lighting device for a motor vehicle, comprising a lighting module according to claim 1.

14. The lighting device according to claim 13, wherein the lighting device is a front headlight for a motor vehicle.

15. The lighting device according to claim 14, wherein the front headlight is a non-dazzling high beam with an adaptive bending low beam.

16. The lighting device according to claim 13, wherein the lighting device additionally comprises another lighting module adjacent to the lighting module.

17. The lighting device according to claim 16, wherein the another lighting module is designed to provide a photometric function of a high beam with a low beam.

18. The lighting device according to claim 13, wherein the lighting module is designed to provide a photometric function of a segmented high beam and a directional lighting function.

19. A lighting module for a motor vehicle, the lighting module comprising:

a printed circuit board assembly (PCBA) support plate;

at least one source of light which is in direct contact with a first face of the support plate;

a heat dissipater which is arranged on a second face of the support plate, opposite the first face, the heat dissipater comprising a base;

a fan sandwiched between the heat dissipater and a plenum, the fan being designed to aspirate a flow of hot air which is dissipated by the heat dissipater, and is obtained from an incoming flow of air; and an optical assembly which cooperates with rays of light of the at least one source of light, in order to produce a light beam, wherein the plenum is configured to cover the fan, the plenum including a peripheral skirt which is designed to surround the heat dissipater and an air outlet, the peripheral skirt covering partly the heat dissipater, wherein the base of the heat dissipater is separate from the support plate, the base of the heat dissipater in its entirety being in direct contact with the second face of the support plate, and protuberances extending from the base of the heat dissipater, the protuberances being in direct contact with the base.

* * * * *